United States Patent [19]

Obéissart

[11] 4,118,093

[45] Oct. 3, 1978

[54] ELECTRICAL CONNECTORS

[75] Inventor: Albert Obéissart, Boulogne-Billancourt, France

[73] Assignee: Souriau & Cie, Boulogne-Billancourt, France

[21] Appl. No.: 777,643

[22] Filed: Mar. 15, 1977

[30] Foreign Application Priority Data

| | | | |
|---|---|---|---|
| Mar. 17, 1976 | [FR] | France | 76 07753 |
| Jun. 24, 1976 | [FR] | France | 76 19275 |
| Oct. 6, 1976 | [FR] | France | 76 30111 |

[51] Int. Cl.[2] ..... H01R 7/06; H01R 13/54

[52] U.S. Cl. ..... 339/75 M; 339/258 R; 339/273 R

[58] Field of Search ..... 339/74 R, 75 R, 75 A, 339/75 M, 273 R, 273 F, 253 R, 252 R, 256 R, 258 R, 258 RR, 217 RJ

[56] References Cited

U.S. PATENT DOCUMENTS

| | | | |
|---|---|---|---|
| 2,567,727 | 9/1951 | Quackenbush | 339/75 R |
| 2,998,588 | 8/1961 | Chamberlain | 339/75 M |
| 3,091,749 | 5/1963 | Felts | 339/75 R |
| 3,094,365 | 6/1963 | Chamberlain et al. | 339/75 R |
| 3,253,250 | 5/1966 | Harrison et al. | 339/258 R X |
| 3,300,752 | 1/1967 | Benoit et al. | 339/253 R |
| 3,383,645 | 5/1968 | Milanese et al. | 339/258 R |
| 4,023,881 | 5/1977 | Migneau | 339/74 R |

*Primary Examiner*—Roy Lake
*Assistant Examiner*—E. F. Desmond

[57] ABSTRACT

Multi-contact electrical connectors having socket-type female contacts and pin-type male contacts, each female contact having a single radially deflecting part which in its deflected position allows the corresponding male contact to enter or withdraw from the female contact with weak or zero force, and which when the male contact is fully inserted is held, possibly by a shiftable control member, in a gripping position in which the deflecting part grips the male contact. The deflecting part has a boss or protuberance projecting outwards radially through a hole in an external casing of the respective female contact so as to be movable by the control member or other abutting structure.

31 Claims, 13 Drawing Figures

ELECTRICAL CONNECTORS

The present invention lies in the field of electrical connectors and, more particularly, electrical connectors with a great number of contacts (for example 100 or 200 contacts).

A first arrangement of the invention applies to electrical connectors of the above-mentioned type comprising female contacts (of the socket type) carried by a first insulating body and intended to cooperate with corresponding male contacts (of the pin type) carried by a second insulating body, each female contact comprising an external casing and being fitted with a longitudinal part made by a radially movable piece which is able to occupy, under the action of control-means, on the one hand, a deflected position for which the introduction or withdrawal of the corresponding male contact is effected with a weak or zero pressing-force and, on the other hand, a gripped position for which the said movable piece is pressed on the above-mentioned male contact, the pressure exercised by the movable piece being obtained at the end of the introduction of the male contacts into the female contacts.

Different connectors of this type are already known.

In the French patent application 73. 27239, in the name of the applicant, the realisation was proposed of, on the one hand, female contacts in the form of tubular units with wide-mouthed orifices and walls fitted with several evenly distributed longitudinal slots which limit the tendency of the resilient strips to deform, at rest, to a position of minimum pressure and, on the other hand, control-means in the form of cylindrical sleeves encircling the female contacts, these sleeves being pushed forwards resiliently under the action of springs to constrain the wide-mouthed parts of the strips and to press them against the male contacts, in connected position, the displacement of these sleeves being obtained by an axial displacement of a movable part of the insulating body carrying the female contacts.

Even if the female contacts used in this known connector gave total satisfaction in the course of use, nonetheless the component parts remain numerous and delicate to make and the assembly is still at a high cost price.

These drawbacks are explained essentially by the necessity to control simultaneously, for each male contact, the radial displacement of the resilient strips forming each female contact, and to do this by means of a single annular unit formed by the sleeve.

In another connection, in the article entitled "Zero insertion force contacts", by T. KEHAGIOGLOU, published in the Journal, "I.B.M. Technical Disclosure Bulletin", Volume 11, no. 10 of March, 1969, it was proposed to arrange female contacts in the form of two strips each presenting an inclined arm forming a slope on which bears the edge of an orifice made in an axially movable part of the insulating body carrying the said female contacts, the said orifice encircling the female contact, the gripping of the corresponding male contact being obtained by axial displacement of the movable part of the insulating body.

There, however, a very particular arrangement is concerned, the female contacts serving as test-clips for electrical or electronic circuits and the male contacts intended to be gripped by the female contacts being movable pins, independent of each other (for example the test pins).

Because of this very structure and because of the nature of the female contacts used, this arrangement cannot be used as the female unit of an electrical connector intended to be connected to a corresponding male unit.

The invention has the object of eliminating the drawbacks of these known arrangements by proposing electrical connectors equipped with female contacts each comprising only one movable piece whose radial displacement can then be ensured by control-means working laterally in relation to the female contact and with a more simple realisation.

It is thus possible to decrease the number of component parts, to simplify the total construction of the connector and consequently to lower the cost price of it.

The electrical connector conforming to the invention is characterised in that the above-mentioned movable piece presents, to cooperate with the control-means, a boss extending outwards and projecting in relation to the external casing of the female contact, the said casing presenting an opening for the passage of the projecting boss.

It is particularly advantageous for the movable piece to be a resilient strip presenting, in its central part, the above-mentioned boss projecting outwards.

In a first mode of realisation of the connector of the invention, in which the female contacts are set in the first insulating body which carries them and in which the second insulating body possesses a frontal face from which project the male contacts it carries, the above-mentioned control-means are formed by a part of the first insulating body arranged so as to be displaceable in the direction in which the female contacts extend and in that the first insulating body comprises, associated with each female contact, a cavity into which the above-mentioned boss extends, this cavity having a depth which varies longitudinally between a maximum depth at the back, for which the movable piece can occupy a deflected position, and a minimum depth at the front, for which the bottom of the cavity bears on the above-mentioned projecting boss to bring the movable piece into its gripped position.

In a second mode of realisation of the connector of the invention, in which the female contacts are set in the first insulating body which carries them and in which the second insulating body possesses a frontal face from which project the male contacts it carries, the control-means comprise a transverse unit movable perpendicularly of the general axis of the female contacts, the said movable transverse unit being provided with at least as many abutments as the connector comprises female contacts, each abutment being placed so as to cooperate with the boss of the resilient strip of the female contact concerned when the movable transverse unit is displaced.

In a third mode of realisation of the connector of the invention, in which the first insulating body comprises a frontal face from which project the female contacts, at least partially, and in which the second insulating body comprises locations and a frontal face on which these locations open, each location protecting at least partially a male contact, for each female contact, the boss of the movable piece is situated on the exterior of the said first insulating body and in the vicinity of its frontal face and the control-means are formed by a support-region arranged on the front part of the internal surface of the axial location of the second insulating body, the relative position of the boss and of the support-region being such that cooperation is effected at the end of plugging-in and that the gripping of the male contact by the female contact is stronger the more the two units of the connector are drawn one to the other.

A second arrangement of the invention applies, in a general way, to the electrical connectors constituted by, on the one hand, a first connector-unit fitted with at least one non-projecting contact carried by a first insulating body and the active part of which is protected by an axial location made in the said insulating body and, on the other hand, a second connector-unit fitted with at least one projecting contact suitable for coming into electrical contact with the above-mentioned non-projecting contact in connected position with the two connector-units, the said projecting contact being carried by a second insulating body and its active part projecting at least partially beyond the frontal face of the said second insulating body, the said projecting contact comprising or being formed by at least one piece movable transversally so as to be able to establish electrical contact with the non-projecting contact while permitting its introduction or its withdrawal with a weak or zero pressing-force from the said non-projecting contact.

According to U.S. Pat. No. 2,269,314 (MacDonald) an electrical connector of this type was already known, in which each pin ends in an enlarged head and is protected, on a part of its length, by a sleeve and in which each socket is fitted, at its extremity, with an external annular protusion.

At the time of engagement, the socket is inserted between the pin and the sleeve, the contact being effected in two places under the gripping-action of the sleeve on the socket: on the one hand, between the enlarged head of the pin and the interior surface of the socket and, on the other hand, between the annular protusion of the socket and the body of the pin.

In this known connector, although the introduction of the pin into the socket can indeed be effected with a weak or zero pressing-force between pin and socket as long as the latter does not reach the sleeve, on the other hand, as soon as the extremity of the socket reaches the edge of the sleeve, the socket is gripped on the pin and the continuation of the introduction is effected by full pressure of the contact.

Moreover, it must be noted that in this known connector, the gripping-force of the socket on the pin diminishes in the course of plugging-in, since the lever arm (distance between the gripping-place of the socket by the sleeve and the free extremity of the socket applied to the body of the pin) increases.

There, then, we are concerned with a very important drawback for not only is the whole of the plugging-in not effected by a weak or zero pressing-force between sockets and pins but in audition this weak or zero pressing-force at every beginning of the plugging-in process reaches in the course of the plugging-in process a maximum volume very violently, to decrease afterwards during the very end of the plugging-in process.

The invention aims to remedy these drawbacks by proposing an electrical connector arranged in such a way that the electrical contact between two pairs of contacts cooperating is only effected at the end of plugging-in and that the pressing-force between the two contacts be stronger the more the two connector-units which carry them are drawn one to the other.

The electrical connector conforming to a second arrangement of the invention is characterised in that, for control of the movable piece forming part of the projecting contact or forming the said projecting contact, the internal surface of the location encircling the non-projecting contact presents a support-area and in that the movable piece of the projecting contact presents a corresponding support-area inducing its transverse displacement in the direction establishing the electrical contact when the support-area of the movable piece of the projecting contact cooperates with the support-area of the location protecting the non-projecting contact, the relative position of the two support-areas being such that their cooperation is effected at the end of plugging-in and that the pressing-force of the projecting contact on the non-projecting contact is stronger the more the two connector-units are drawn towards each other.

Apart from its particular arrangements, the invention comprises in itself certain others which are used for preference at the same time and which will be more explicitly considered in the description which follows of certain of its modes of realisation given purely by way of illustrated but not at all limiting example.

In this description reference is made to the accompanying drawings in which.

Figure 10:
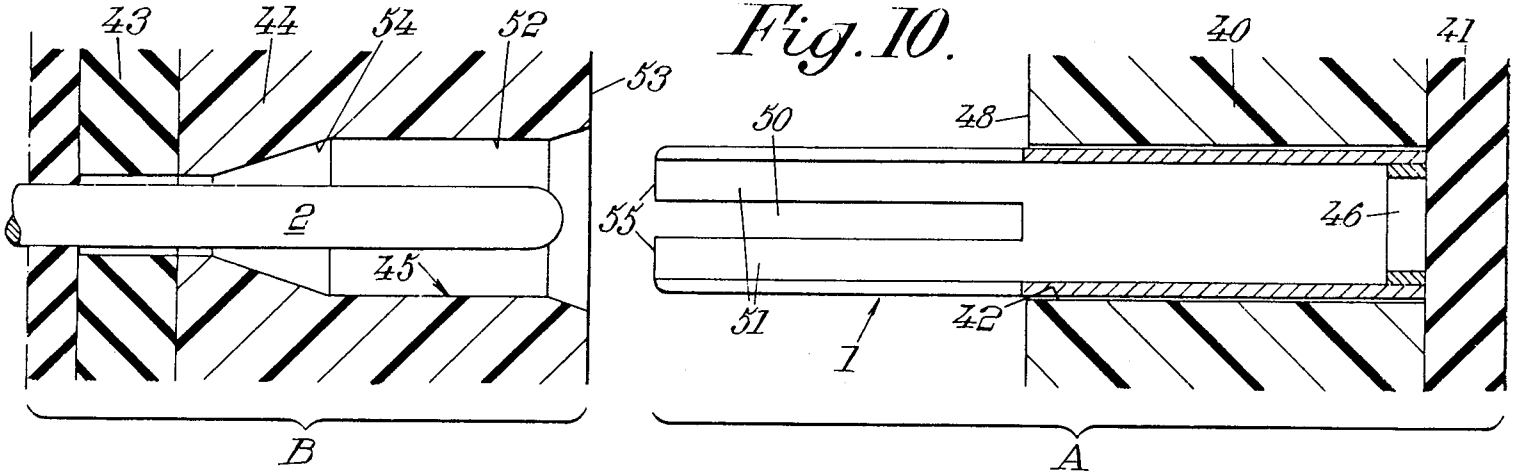
Figure 11:
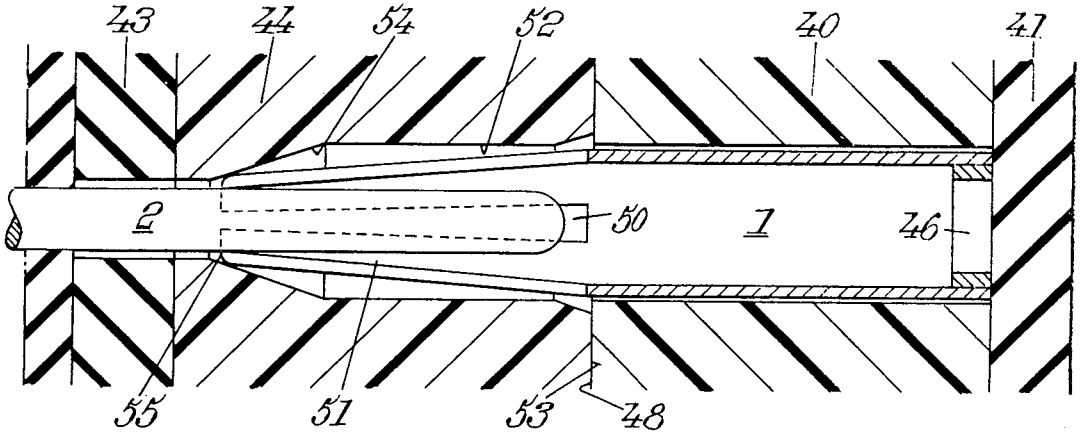
Figure 12:
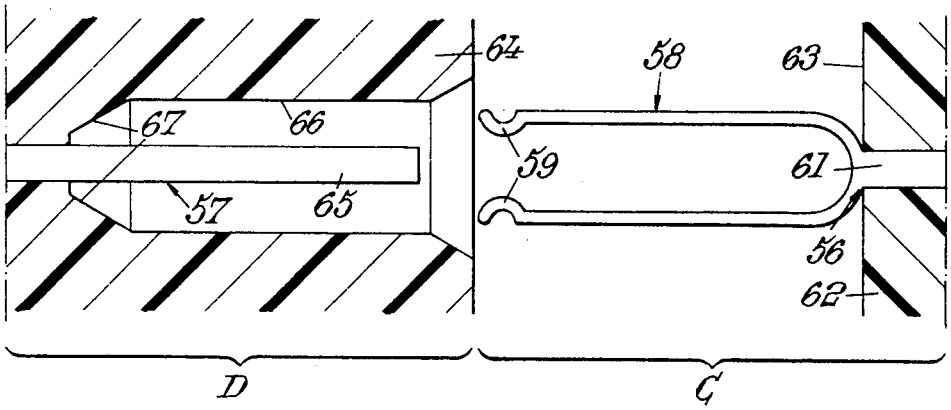
Figure 13:
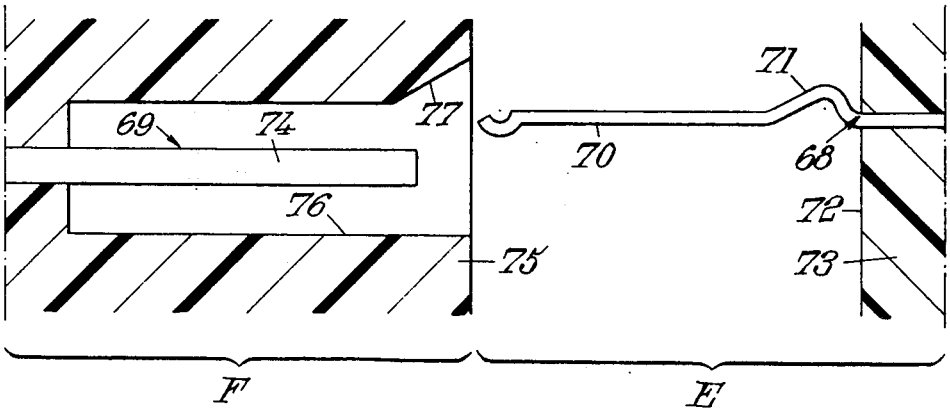

FIGS. 10 and 11 represent partially, in section and on a large scale, two connector-units fitted respectively wth male and female contacts respectively, in disconnected position and in connected position and arranged according to the second arrangement of the invention, and FIGS. 12 and 13 represent partially and on a large scale two other types of connectors arranged according to the second arrangement of the invention.

It will be useful to define immediately the terms "front" and "back" which will be used in the description.

Figure 1:
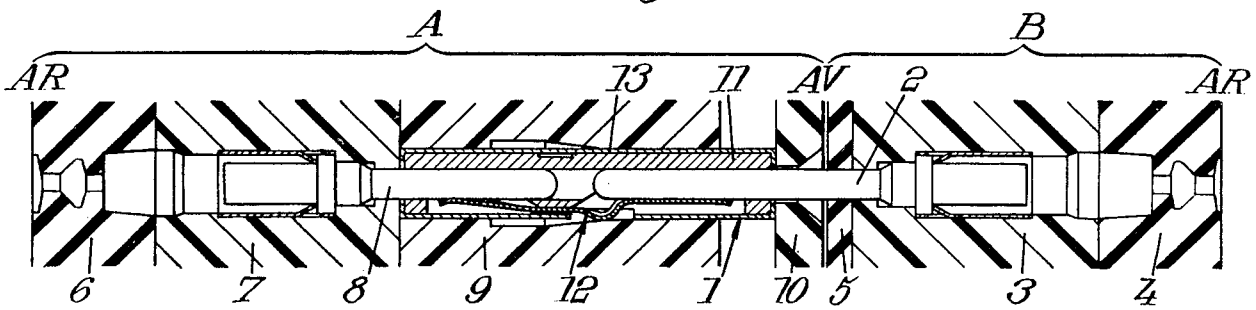
FIG. 1 is a partial axial section of the connector, represented in connected position, corresponding to the first mode of realisation of the first arrangement of the invention.

By "front part" of a piece of the connector-unit, one means the part of this piece which is turned towards the other connector-unit connected wth the said unit, when the two units are presented one opposite the other for connection (side AV in FIG. 1).

In the same way, by "back part" of a piece, one means the part of it which is turned towards the electrical conductors fixed to the connector-unit (side AR in FIG. 1).

To begin with, a first arrangement of the invention will be described whose three different modes of realisation are represented in FIGS. 1 to 9.

FIG. 1 represents partially an electrical connector of a type concerned in the first arrangement of the invention; only represented are the insulators of the connector supporting the electrical contacts, with no regard to the general form (cylindrical or parallelepipedic) of the connector and various rings and exterior casings of the insulators which serve to ensure the functioning and the fluid-tightness of the connector.

The connector is made up of a female unit A fitted with sockets 1 opening on its front part and with a male unit B fitted with pins 2 suitable, in connected position (represented in FIG. 1 of the two units A and B), for cooperating with the sockets 1.

To simplify the drawing, only one socket and one pin have been represented.

For reasons of standardization and to reduce the production costs, it is advantageous, as represented, to arrange matters so that, in the female unit A, the connection between electrical conductors (not represented) and sockets is made through the intermediary of pins identical to pins 1, in such a way that the back of the female unit A is identical to the male unit B.

According to this arrangement, it can be seen that:

as regards the male unit B, it comprises essentially an insulating body 3 with a back head 4, the pins 2 being carried by the said insulating body 3 and crossing a front plate 5, the pins 2 being fixed in the insulating body 3 in a manner wholly known in itself, and, as regards the female unit A, it comprises the connection of a back head 6 and a first insulating body 7 (being presented at the back of the unit), identical to the assembly 4, 3 of the male unit B and carrying pins 8, with a second insulating body 9 (located at the front of unit A) carrying the sockets 1 arranged to cooperate, in their back parts, with the corresponding pins 8 and to cooperate, in their front parts, in connected position, with the pins 2 of the male unit B, the female unit A comprising moreover a front plate 10 crossed by the pins 8 in connected position.

It will be noted that the different parts 6, 7, 9 and 10, as well as the pins 8 and the sockets 1, are assembled once and for all in the course of the fitting on of the connector-unit B and that, as far as concerns its use, the unit B is identical to a unit fitted with sockets with shanks of conventional type.

In what now more especially concerns the sockets 1, they are arranged so as to be able to exert automatically under the action of the control-means a variable gripping-force allowing the introduction or the withdrawal of the pins 2 with a weak or zero pressing-force between sockets and pins.

Figure 2:
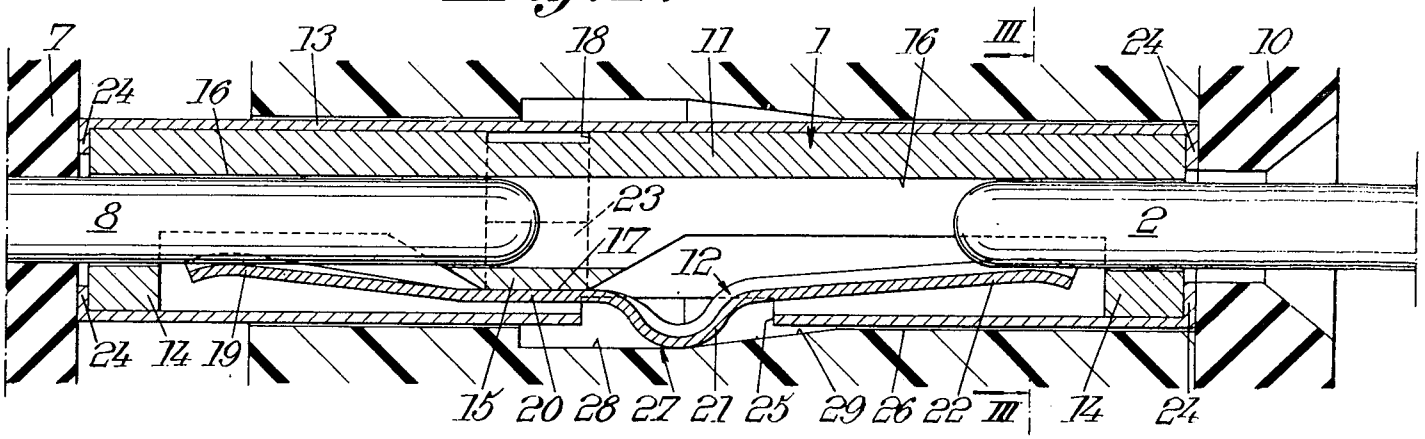
FIG. 2 represents, on a larger scale than FIG. 1, female contacts of the connector in FIG. 1 in a first operative position.
Figure 4:
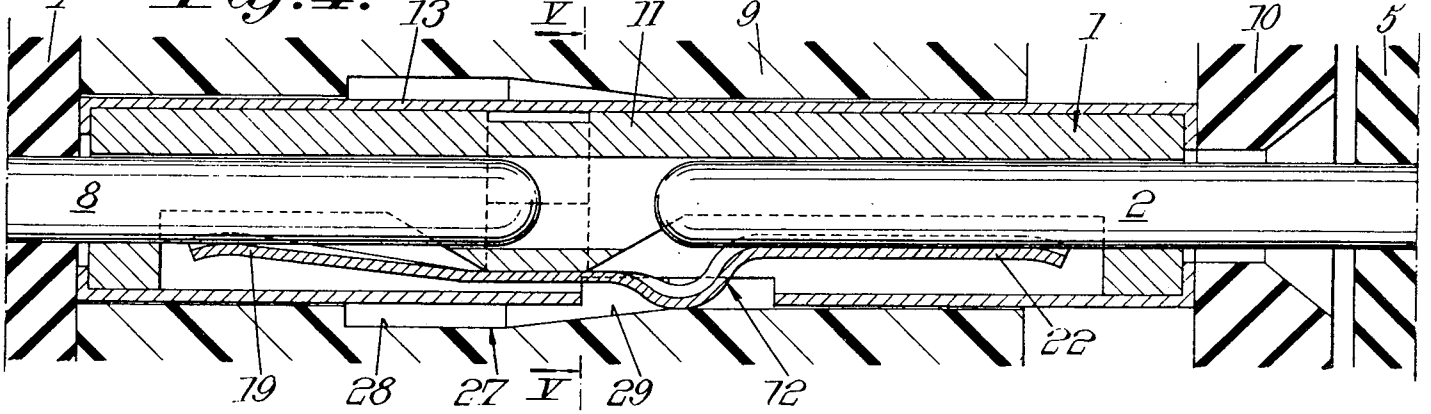
FIG. 4 represents, on a larger scale than FIG. 1, a female contact of FIG. 2 in a second operative position.

As can be seen in FIG. 1 and as can be seen more clearly for example in FIGS. 2 and 4, each socket 1, according to the first arrangement of the invention, is made essentially of three pieces, namely:

an elongate piece or support 11, of metal, intended to guide the pins 2 and 8 at the time of their introduction or their withdrawal and suitable for ensuring, should the occasion arise, an electrical contact between the said pins;

a resilient elongate strip 12 ensuring the electrical contact between the pins 2 and 8 in connected position, and a cylindrical metal casing 13 having mainly the role of keeping the support 11 and the strip 12 assembled.

The support 11 is constituted by a tubular unit of an interior diameter slightly greater than that of the pins 2 and 8, this unit being machined to allow annular parts to exist only in three places; two annular parts 14 located respectively at its extremities, and an annular part or hoop 15 located slightly back from its transverse median plane.

Figure 3:
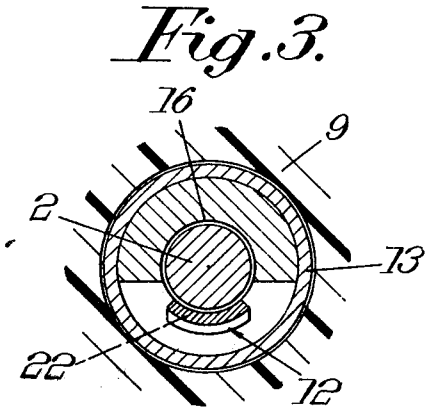
FIG. 3 is a transverse section, along the line III—III, of FIG. 2.

Between each of the annular parts of the extremities 14 and the hoop 15, the material has been eliminated substantially on a half-circumference so as to form grooves 16 (see also FIG. 3).

Moreover, the part of the external surface of the hoop 15 diametrically opposite the grooves 16 is machined to present a flat 17 (see also FIG. 5) with an intention which will be made clear later on.

Finally, the lateral walls of the hoop 15 are provided with a groove 18, having substantially the same width as the flat 17, which groove, to facilitate the realisation thereof, can completely encircle the support, from one side of the flat to the opposite side (as represented in the figures).

The resilient strip 12 presents a configuration in which can be distinguished, from back to front, four parts:

a flexible part 19 intended to cooperate with the pin 8 and incurved transversally, the concavity being turned towards the pin 8 in such a way that this part 19 substantially marries with the curve of the pin 8 and so ensures a good electrical contact with the latter;

a flat part 20 whose length corresponds substantially to the length of the flat 17 of the hoop 15, this flat part 20 resting on the flat 17;

a boss 21 projecting in the opposite direction to the hoop 15, this boss projecting outside the casing 13, and finally another flexible part 22 intended to cooperate with the pin 2 and transversally incurved, the concavity being turned towards the pin 2 to obtain a good electrical contact between the two pieces, this flexible part 22 forming the movable element of the socket 1 whose radial displacement allows the insertion or withdrawal of the pin 2 with a zero pressing-force between socket and pin (or rather between strip and pin), as will be made more clear in detail later on.

It will be noted that the strip 12 comprises moreover two lateral tabs 23 on both sides of the flat part 20 (see FIG. 5), these tabs 23 having substantially the same width as the groove 18 and being curved so that in the fitted position of the strip 12 on the hoop 15, the tabs 23 lodge in the groove 18 by marrying with its curve.

This very simple arrangement allows the strip 12 to be axially fixed to the support 11 by simple jointing; the flat 17 of the support and the flat part 20 of the strip 12, from the fact of their cooperation, prevent the strip 12 from turning around the support 11; finally, the tabs 23 of the strip 12 engaged in the groove 18 prevent the strip from being displaced axially in relation to the support 11.

It will be observed that the configuration of the strip 12 is such that, if the flat part 20 is considered as reference plane means, the other parts of the strip are situated on both sides of this plane: the boss 20 projects outwards and the flexible parts 19 and 22 are folded back towards the interior of the socket, in such a way that they can be pushed back resiliently radially outwards by the pins, respectively 8 and 2, when the latter are driven into the socket.

As for the exterior casing 13, it is presented in the form of a tubular unit encircling the support 11 and whose extremities 24 are cut out and folded inwards to maintain the assembly of the support 11 and of the strip 12 which are introduced into the interior of the casing.

Substantially at its middle, the casing 13 comprises an opening 25 of sufficient dimension to allow passage of the boss 21 of the strip 12.

The socket 1 having the construction described above, it can therefore be stated that, the front extremity of the strip 12 tending resiliently to constrain itself towards a position of zero pressure and freeing, in the said position, the orifice of the annular part 14 situated at the front of the support 11, a radial force directed towards the interior of the socket, exercised on the boss 21, by appropriate control means, suffices to displace the extremity 22 of the strip 12 in the direction of the groove 16 situated opposite.

According to a first mode of realisation of the connector represented in FIGS. 1 to 5, to ensure the operative function of the said control-means, an axial displacement of the second insulating body 9 is provided for, the body's front part being brought into contact with the front plate 10 at the beginning of assembly and of mechanical separation of the two units A and B and its back part being brought into contact with the first insulating body 7 at the end of assembly and/or of securement and of mechanical separation of the two units A and B.

The driving of the insulating body 9 between the two positions indicated above can be effected by all the appropriate means lying within the scope of the present invention and of which some examples will be given later.

These control-means can thereby be realised in a simple way since they are connected at the axial displacement of the insulating body 9.

Substantially at the level of the opening 25 of the casing 13 of the socket 1, the wall of the axial location 26, traversing the insulating body 9 and in which the socket 1 is placed, comprises a groove 27 having a variable depth, this depth being maximal at the back of the groove and returning, by a sloped part, to the level of the surface of the location 26.

Although this groove 27 can be presented in the form of a groove with a longitudinally disposed axis, it is however preferable, to facilitate its realisation, that it be formed by an annular groove comprising a first cylindrical part 28, situated at the back, and a truncated-conical part 29 situated at the front, the depth of the cylindrical part 28 being substantially equal to the protusion of the boss 21 from the strip 12.

Moreover, although it is not represented in FIGS. 1 to 5 in order not to complicate the disclosure, it is desirable that the insulating body 9 be realised in two pieces, the cylindrical groove 28 being realised in the front face of the back piece and the truncated-conical groove 29 being realised in the back face of the front piece, the two pieces being then permanently made solid with one another in any appropriate way.

As has been already said, once the female unit A of the connector has been completed, the pin 8 cooperates permanently with the socket 1 and, thereby, the flexible back part 19 of the strip 12 remains continually supported on the pin 8. Thereby, it will be observed that strip 12 is constantly supported at three points: its back part 19 rests on the pin 8, its flat part 20 rests on the ledge 17 of the hoop 15 of the support 11 while the tabs 23 rest at the bottom of the groove 18 and, finally, the boss 21 rests against the insulator, at the bottom of the groove 27.

The functioning of the socket 1 will now be described, supposing that the pin 8 is already in place as represented in FIG. 2.

At rest, that is to say the female unit A not being engaged with the male unit B, the insulating body 9 is pushed back resiliently against the insulating body 7 under the action of means known in themselves which do not come within the scope of the present invention. Thereby the boss 21 of the strip 12 rests against the high part of the groove 27 and the extremity 22 of the strip 12 is pushed back towards the interior of the socket 1 (gripped position).

At the beginning of the mechanical engagement of units A and B, at the moment when the pins 2 approach the holes cut in the front plate 10, the insulating body 9 is driven towards the front to contact with the plate 10. In the process of the movement, the boss 21 bears resiliently on the sloped part 29 of the groove 27 and tends to free the passage up which the pin 2 goes until it cooperates with the cylindrical part 28. It then occupies the separate position (see FIGS. 2 and 3) in which the pin 2 can enter into the socket 1 without being in contact with the flexible part 22 of the strip 12 or at the very least, if this contact exists, the strip 12 does not bear sufficiently on the pin 2 to exercise a pressing-force resisting the penetration of the said pin.

Figure 5:
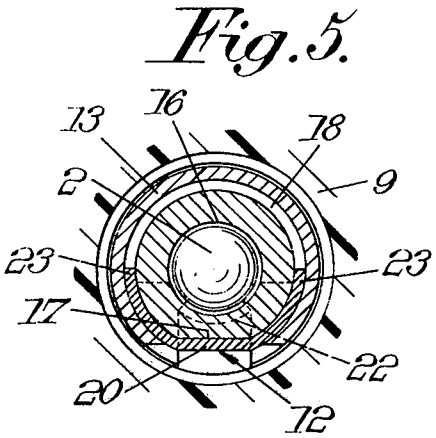
FIG. 5 is a transverse section of FIG. 4 along the line V—V.

Once the pin 2 is completely driven into the socket 1, that is to say towards the end of the mechanical connection of the two elements A and B, or towards the end of the eventual mechanical securement of this connection, the insulating body 9 is pushed backwards into contact with the insulating body 7, the consequence of this being that, as a result of the cooperation of the boss 21 of the strip 12 with the sloped part 29 of the groove 27, the extremity 22 of the strip 12 bears firmly on the pin 2, putting the latter in electrical contact with the pin 8 (see FIGS. 4 and 5).

Disconnection is effected according to the reverse process which is about to be described.

As has been said above, the means to be put in operation to ensure the displacement of the insulating body according to the sequence described above do not come within the scope of the invention and can be of any known type, adapted to the type of connector concerned.

By way of information, such means are described in the following French patent applications, all in the name of the applicant:

73. 27239 (published under the number 2,259,025 for a cylindrical connector with a turning ring;
75. 38312 for a parallelepipedic connector;
76. 03999 for a rectangular connector for a printed circuits board.

Of course all other appropriate means can be suitable to realise the displacement in question.

It will be noted that, although the insulating body 9 is movable axially, the sockets 1 are, themselves, fixed and maintained in position by being trapped between the front face of the insulator 7 and the back face of the front plate 10. This simple arrangement allows the insulating body 9 to displace itself freely on the sockets 1.

Figure 6:
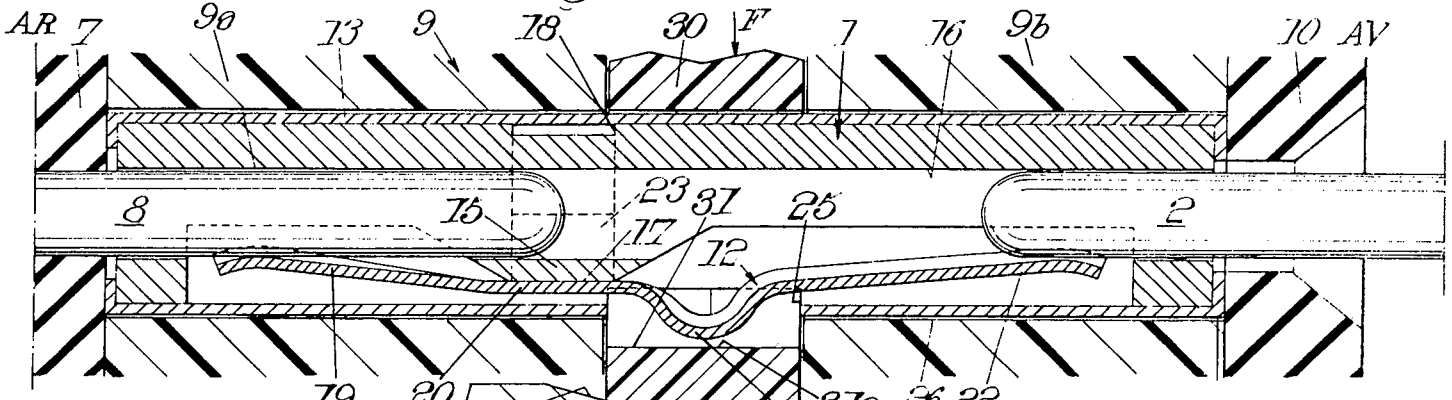
FIGS. 6 and 7 represent, on a large scale, and in two different operative positions, a pair of female and male contacts conforming to a second mode of realisation of the first arrangement of the invention.
Figure 7:
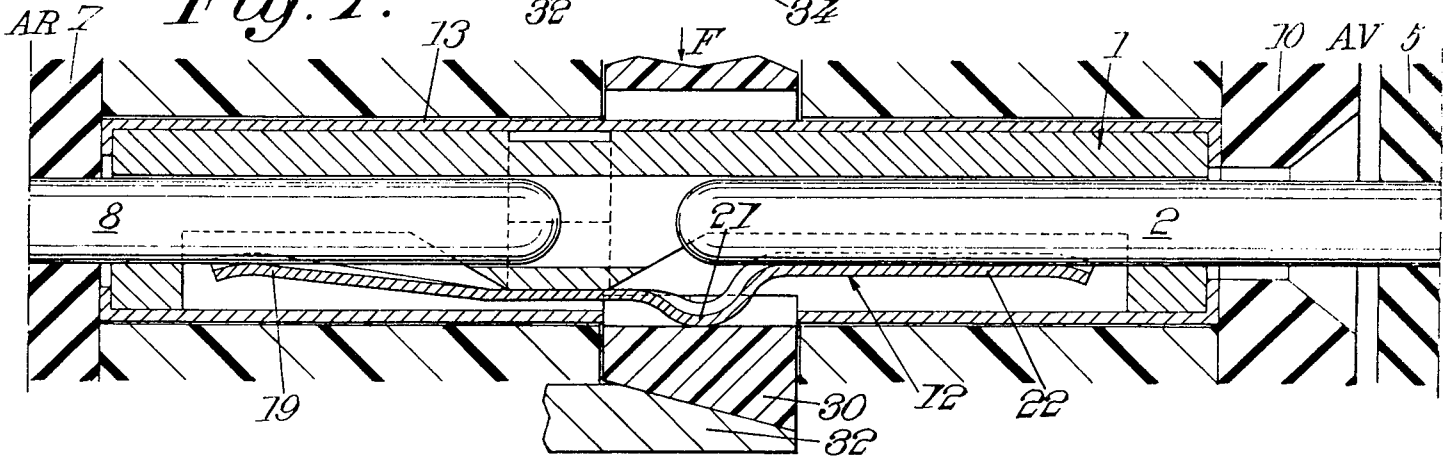

By referring to FIGS. 6 and 7, there will now be described a second mode of realisation of an electrical connector coming within the scope of the first arrangement of the invention, the units of this connector which are identical to the corresponding units of FIGS. 1 to 5 being indicated with the aid of the same numerical references.

In the first mode of realisation which has just been described, the travel necessary for the axial displacement of the insulator 9 increased by as much the length of the female unit A of the connector, which, for certain fields of use of the connector, can be somewhat inconvenient.

To obtain a more compact female unit, provision is made, in the second mode of realisation, for the control of the strip 12 to be no longer effected by the displacement of the insulating body, but with the aid of a transverse, radially movable, unit.

To this end, the insulating body 9 is realised in two parts 9*a* and 9*b* situated axially on both sides of the bosses 21 of the strips 12 and between which parts there is placed, in such a way as to be able to slide radially, the afore-mentioned transverse unit which is presented preferably in the form of a flat plate 30 of insulating material.

This plate is pierced with holes 31, equal in number to that of the sockets, which encircle the latter, these holes being either circular with a diameter greater than that of the sockets, or lengthened in the direction of displacement of the plate.

The part 31*a* of each hole 31 which is situated opposite the boss 21 of the corresponding strip 12 serves then as abutment to guide the strip 12 and bring its flexible part into contact with the pin 2, at the end of the connection of the two units A and B.

By way of example, in the case of a connector of the cylindrical type fitted with an exterior ring 32 serving as securement for the mechanical assembly of the two units A and B, the internal face of this ring can be provided wth a slope 33 suitable for co-acting with a surface 34 of the opposed extremity of the plate 30, this extremity then projecting outside the exterior casing (not represented) of the female unit A.

In the non-connected position of the female unit A, the parts 31*a* of the holes 31 of the plate 30 are kept apart from the bosses 21 of the strips 12 by the action of resilient means, for example a return-spring (not represented in FIGS. 6 and 7) placed at the extremity of the plate 30 opposite the surface 34 and acting in the direction of the arrow F. It is then the sockets 1 themselves which are able to serve as abutments to arrest the plate 30.

The functioning of a connector thus arranged is as follows.

At the beginning of the assembly of the female unit A with the male unit B, the abutments 31*a* of the holes 31 not cooperating with the bosses 21 of the strips 12, the flexible branches 22 are disengaged in the interior space of the sockets 1, and the pins 2 enter freely into the corresponding sockets.

At the end of plugging-in, to secure the mechanical assembly of the two connector-units, the securement-ring 32 is operated in an appropriate way to cooperate with the complementary agent (screw-threads, ramps) provided at the front of the exterior casing (not represented) of the male connector-unit B. Whatever its mode of functioning, this actuation of the ring 32 is accompanied by an axial displacement of the latter; thereby the slope 33 provided on the interior surface comes into contact, at a given moment, with the surface 34 of the plate 30, and pushes back the latter transversally, against the force F exercised by the return-spring.

In the process of this displacement of the plate 30, the parts 31*a* of the holes 31 of the plate come into contact with the bosses 21 and push back the flexible branches 22 of the strips 12 against the pins 2 (FIG. 7), preferably by lightly flattening them out against the said pins so as to establish free contacts despite the clearance necessary for a correct functioning of the connector.

Inversely, at the disconnection, the setting in motion of the securement-ring causes its axial displacement to the back of the female unit A. The plate 30, freed and pushed back under the action of the force F exercised by the return-spring, returns to its original position in abutment against the sockets 1. The abutments 31*a* having been separated from the bosses 21, the flexible branches 22 separate from the pins 2, and the withdrawal of the male unit B of the connector can be effected without friction between the branches 22 of the strips 12 and the pins 2.

Of course, the preceding example is only given as an illustrative example and has nothing limiting about it since the invention can be applied to connectors of other different types than the cylindrical type.

The actuation of the plate 30 can be controlled by entirely other means than a locking-ring and one could just as well obtain the same result by making the interior surface of the front part of the exterior casing 36 of the male unit B cooperate or by providing a pull-fastener manually operable by the operator at the end of the mechanical assembly of the two connector-units, or with the aid of other more complex means.

In the same way, it is possible to avoid the use of a return-spring, provided that the plate 30 is connected mechanically to the locking-ring 32, for example by means of a captive pin, solid with the plate, sliding in a sloped guide provided in the place of the slope 33.

It is equally possible to provide, in the place of the holes 31, elongate grooves whose bottoms constitute the abutments of the actuation of the resilient strips 12, the plate 30 fitted with these grooves then presenting the appearance of a comb.

It will also be noted that, for the first and second modes of realisation of the invention which have just been described, it is not essential to resort to a double socket such as that described and represents in FIGS. 1 to 7; a simple socket can be used cooperating at the front with the pin 2, and terminating at its back part in a shank of some form or other for an appropriate contact with the corresponding electrical conductor (soldering, crimping, coiling, or wrapping).

It is advisable then that the part of the support 12 situated at the back of the hoop 15 be replaced by a shank of any form desirable for an appropriate connection with the electrical conductor (connection by soldering, by coiling or wrapping, by crimping) and that the flexible back part 19 of the strip 12 be eliminated.

There will now be described, with reference to FIGS. 8 and 9, a third mode of realisation of the invention which, in the same way as the second mode of realisation, especially allows shortening of the length of the female unit A, thereby making the connector more compact.

Figure 8:
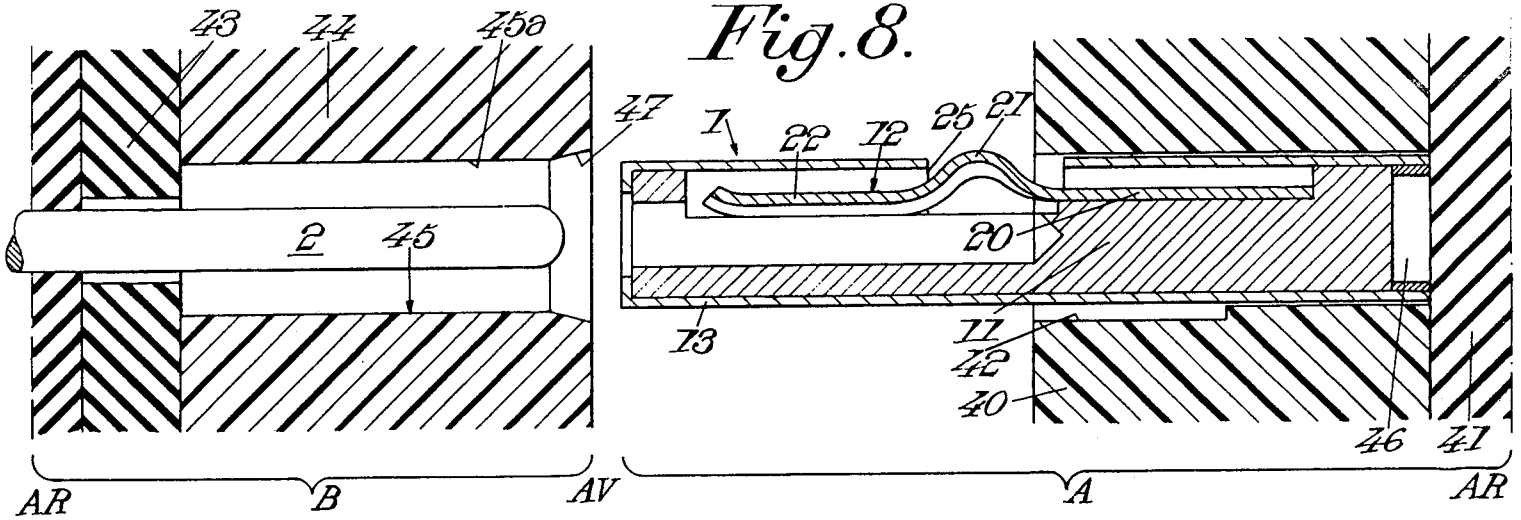
FIGS. 8 and 9 represent, on a large scale, and in two different operative positions, a pair of female and male contacts conforming to a third mode of realisation of the first arrangement of the invention.

According to FIG. 8, it can be seen that:

as regards the female unit A, it comprises mainly an insulating body 40 with back head 41, the sockets 1 being placed in axial locations 42 pierced in the said insulating body 40 and being fixed there in any manner known in itself, a front plate (not represented) positionable against the front face of the insulating body 40, and as regards the male unit B, it comprises the association of an insulating body 43 carring the pins 2 which are fixed there in any known manner and an insulating body 44, situated in front of the insulating body 43 and pierced by axial locations 45 in which the pins are protected, a back head (not represented) being moreover provided at the back of the insulating body 43.

Now, more especially, as far as the sockets are concerned, here they are of a simple type, that is to say arranged to cooperate with the single pins 2, although double sockets such as those mentioned above in the description can also be quite as suitable.

Thereby, the composition of each socket is appreciably the same as before, namely:

- a support 11 intended to guide the corresponding pin 2 from the time of its introduction or its withdrawal,
- an elongated resilient strip 12, comprising a flat part 20, a boss 21 and a flexible contact-branch 22,
- and a cylindrical casing 13 having mainly the role of maintaining the assembly of the support 11 and the strip 12, this casing being provided with an opening 25 through which projects the boss 21 of the strip 12.

But unlike the socket previously described, because of the absence of the back pin, the back part of the socket has a simplified form:

- the flexible back part of the strip 12 no longer exists,
- the part of the support situated to the rear of the boss is massive and is extended by a cylindrical stem or shank 46 whose free extremity (not represented) is arranged to be made solid with the corresponding electrical conductor (not represented) in any appropriate way (soldering, crimping, coiling or wrapping).

According to this third mode of realisation, the sockets 1 are not totally driven into the axial locations 42, and all the front part of the sockets situated beyond the bosses 21 (and comprising these bosses) project beyond the front face of the insulating body 40.

Now, as far as the pins 2 are concerned, it has been indicated above that they are lodged in the axial locations 45 of the front insulating body 44. The diameter of these locations is slightly greater than the exterior diameter of the sockets 1, so that at the time of the assembly of the connector-units A and B, the parts of the sockets which project beyond the front face of the insulating body can enter into the locations 45.

The control-means of the radial displacement of the strips 12 are formed, in a very simple manner, for each contact, by a support-region 45*a* arranged on the front part of the internal surface of the location 45 which is situated, in connected position, opposite the corresponding boss 21. In other words, it is the insulating body 44 itself which, by the intermediary of the front regions of the cavities 45, serves to control the radial displacement of the strips 12.

It is therefore important that the following conditions are taken into account to obtain a satisfactory functioning of the connector:

- the diameter of the locations must be greater than the exterior diameter of the sockets, but must not be too great in order that the bosses 21 and flexible branches 22 be pushed back radially into the sockets, when the support-areas 45*a* reach the level of the bosses 21
- the bosses 21 must be situated in front of the frontal face of the insulating body 40 without, however, being too distant from it, so that the bosses are only contacted by the areas 45*a* of the locations 45 at the end of the plugging-in of the two connector-units A and B.

In order to facilitate the entrance of the bosses 21 into the locations 45, it is desirable that the front region 45*a* of the said cavities be sloped to form ramps 47. Preferably, with the aim of simplifying the making of the insulating body 44, it is advantageous that the front part 47 of the locations 45 be truncated-conical.

As has been indicated above, it is possible to equip the connector which has just been described with double sockets cooperating at the back with pins. It is no longer essential that the male unit be fitted with two insulating bodies 43 and 44: a unitary insulating body comprising the requisite cavities 45 can be just as suitable.

A second arrangement of the invention, with reference to FIGS. 10 to 13, will now be described.

In the three modes of realisation of the first arrangement of the invention which has just been described, the gripping of the pins by the sockets was obtained in a relatively simple way. In particular, in the third mode of realisation, the control-means acting on the sockets were simplified in the extreme, while obtaining good dependability and an improved reliability.

However, the sockets used are mainly formed of three assembled pieces, which, for certain fields of use of the connectors, present the drawback of too high a cost price.

In carrying out the second arrangement of the invention, one seeks to further lower the cost of the connector by simplifying to the maximum the structure of the female contacts, while keeping the principles of functioning of the third mode of realisation of the connector corresponding to the first arrangement of the invention, namely: pins protected in the repsective axial locations provided in the insulating body which carries them and sockets simplified in the extreme projecting from the insulating body which carries them.

Figure 9:
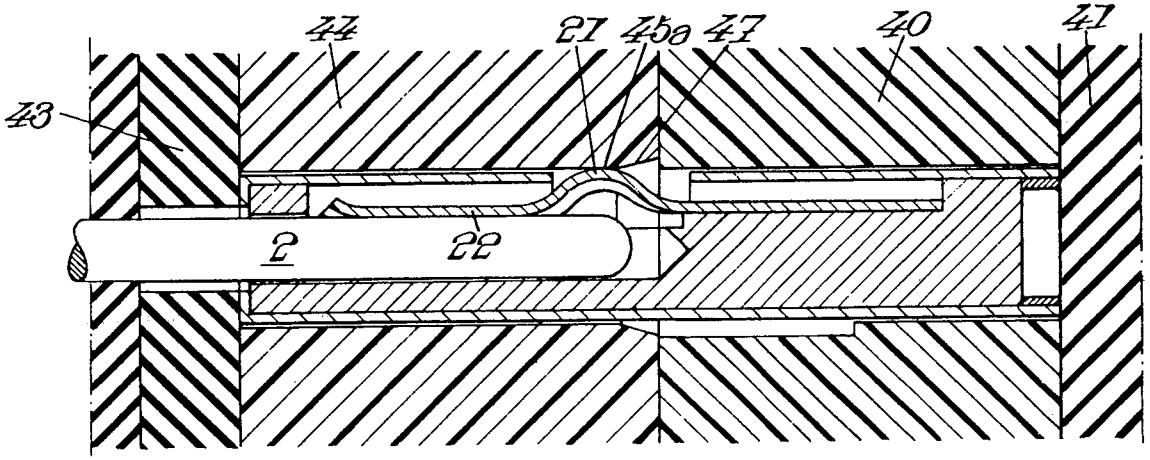

In FIGS. 10 and 11 in which the identical units to those of FIGS. 8 and 9 are designated by the same references, only a part of a female connector-unit A has been represented, fitted with a socket 1 arranged to cooperate with a pin 2 making part of a male connector-unit B also represented only partially.

One sees that:

as regards the female unit A, it comprises mainly an insulating body 40 with a back head 41, the sockets 1 being placed in the axial locations 42 pierced in the said insulating body 40 and being maintained there in any manner known in itself, a front plate (not represented) provided, should the occasion arise, against the frontal face 48 of the insulating body 40, and, as regards the element B, it comprises the association of an insulating body 43, carrying the pins 2 which are fixed there in any manner known in itself, and an insulating body 44, situated in front of the insulating body 43 and pierced by axial locations 45 in which are engaged the active parts of the pins, a back head (not represented) being moreover provided behind the insulating body 43; it will be noted that the interior diameter of the locations 45, at the level of the active part of the pins, is distinctly greater than the diameter of the pins.

More especially, as far as the sockets 1 are concerned, they are of the cylinder-of-revolution type known in itself. The wall of these sockets is cut in the axial direction by the longitudinal slots 50 (for example up to four in number as represented in the figures, the number of slots, however, not being crucial) delimiting between them radially resiliently flexible strips 51 (incurved transversally).

Equally it will be noted that the sockets 1 are not completely engaged in the locations 42, but that they partially project beyond the frontal face 48 of the insulating body 40.

Finally, in their rest-position, that is to say their non-gripped position, the sockets 1 have an interior diameter substantially greater than the exterior diameter of the pins 2, in such a way that at the beginning of the introduction of the pins into the sockets or at the end of separation, the sockets do not grip the corresponding pins. As for the exterior diameter of the sockets, it is slightly less than the diameter of the orifice of the locations 45.

In conformance with the second arrangement of the invention, to control the gripping of the pins by the sockets at the end of the connection or to induce the slackening of this gripping-force at the beginning of disconnection, provision is made for a narrowing of the diameter of the locations 45 encircling the pins, the part of least diameter to be found at the bottom of the locations.

In the case of sockets with smooth and cylindrical walls represented in the figures, it is advantageous that the variation in diameter of the locations 45 be progressive. To this end, each location 45 comprises, on the one hand, a cylinder-of-revolution surface 52 situated at the front of the location and opening on the frontal face 53 of the insulating body 44 and, on the other hand, a truncated-conical surface 54, of conicity converging towards the bottom of the location 45, and situated near the bottom of this location.

The respective axial lengths of the surfaces which are truncated-conical 54 and cylinder-of-revolution surfaces 52 are functions of the lengths of the cooperating parts of the sockets 1 and of the pins 2.

At the time of the introduction of a pin into a socket 1, the socket enters into the location 45 without exercising appreciable force on the pin until the free extremities 55 of the strips 51 come into contact with the truncated-conical surface 54 of the location 45.

At this moment, the extremities 55 slide on the truncated-conical surface 54, the strips 51 are brought together one against the other and, finally, grip the pin 2, as represented in FIG. 11.

Of course an identical result will be obtained if the truncated-conical surface 54 stretches axially throughout the whole length of the location 45.

Although the truncated-conical surface 54 constitutes a preferred mode of realisation, the control sought will be equally well obtained for the variable gripping-force of the sockets with the aid of a simple annular shoulder situated in the location at an appropriate place, near the bottom of the location 45, the extremities 55 of the strips 51 presenting a sloped face suitable for co-acting with the shoulder.

Thus, thanks to the particular arrangement of the internal surface of the locations 45 which has been described, it is possible, in conformity with the sought object, to equip the two connector-hunits A and B with contacts, sockets and pins of types known in themselves, presenting no special configuration, and widely used in connectors of different types.

The second arrangement of the invention is not limited to the single mode of realisation which has just been described and which is represented in FIGS. 10 and 11. It can on the contrary be applied to connectors fitted with different contacts of sockets and pins.

In FIG. 12, there has been partially represented a female connector-unit C fitted with female contacts 56 suitable for cooperating with male contacts 57 forming part of a male connector-unit D.

The active parts 58 of the female contacts 56 have the general appearance of a lyre with two branches 59 connected in one shank 61 engaged in an insulating body 62 (only one part of which is visible in FIG. 12). Moreover, the active parts 58 project from the frontal face 63 of the insulating body 62.

The male contacts 57 are constituted by rectilinear metal strips set in an insulating body 64 (only one part of which is visible in FIG. 12). The active parts 65 of contacts 57 are protected in the locations 66 whose bottom is sloped to form ramps 67.

To allow a plugging-in or a separation of the two connector-units C and D with a weak or zero pressing-force between the contacts 56 and 57, it is advantageous that the separation of the two branches 59 of the contacts 56 be slightly greater than the thickness of the active parts 65 of the contacts 57.

The gripping of the active parts 65 of the strips 57 by the branches 59 is obtained, at the end of plugging-in, by cooperation of the extremities of the said branches 59 with the ramps 67.

Of course, the scope of the invention is not being exceeded, when the strips 57 are protected, not in the respective locations 66 but in a single longitudinal groove, having the requisite conformation transversally, provided in the insulating body.

In FIG. 13, there has been partially represented a still simpler configuration of the connector: the two connector-units E and F are fitted respectively with elongate contacts 68 and 69 formed of simple, transversally flexible metal strips.

The contacts 68 project from the frontal face 72 of the insulating body 73 which carries them and the active parts 70 of these contacts 68 are fitted with a boss 71 situated near the said frontal face 72.

The active parts 74 of the contacts 69 (which are carried by an insulating body 75) are protected in the locations 76 whose parts are provided with ramps 77 suitable for cooperating with bosses 71 of the contacts 68 of the unit E to obtain the establishment of the electrical contacts at the end of the plugging-in of the said unit E into the unit F.

The two modes of realisation which have just been described with reference to FIGS. 12 and 13 lend themselves easily to the establishment of connections with a printed circuit board, the contacts 57 of the unit D (FIG. 12) or 69 of the unit F (FIG. 13) being formed of printed tracks at the edge of the board and the insulating bodies 64 (FIG. 12) or 75 (FIG. 13) being formed of an insulating piece having the desired profile and borne by the printed circuit board.

In a general way, it will be noted that, according to the first and second arrangements which have just been described, the different arrangements of the female contacts and the male contacts, with projecting contacts and sheltered contacts, and the control-means for the pressing-force of the former on the latter are such that, in all cases, the cooperation of pairs of contacts is made at the end of the plugging-in of the two connector-units which carry them and that the pressing-force of the female (or projecting) contacts on the male (or sheltered (contacts is stronger the more the two units of the connector are drawn towards each other.

As is evident, and as moreover results already from what preceeds, the invention is not limited only to those of its modes of application and of realisation which have been more especially envisaged; it embraces, on the contrary, all the variants.

I claim:

1. In an electrical connector comprising first and second connector units, first and second insulating body means located in said first and second connector units respectively, a plurality of female contacts of socket type carried by said first insulating body means, and a plurality of corresponding male contacts of pin type carried by said second insulating body means, each female contact comprising an external casing and a longitudinal part, said longitudinal part being formed of a radially movable piece, control means acting on said movable piece so that said movable piece can be placed on the one hand in a deflected position for which the introduction or the withdrawal of the corresponding male contact is made with a weak or zero pressing-force and, on the other hand, in a gripped position for which said movable piece is pressed against said male contact, the pressure exerted by said movable piece being obtained at the end of the introduction of the male contacts into the female contacts, the improvement that said movable piece is provided, for cooperation with said control means, with a boss extending outwards and projecting from the external casing of the female contact, said casing being provided with an aperture for the passage of the projecting boss.

2. Electrical connector according to claim 1, wherein the movable piece is a resilient strip provided, in its central part, with said boss projecting outwards.

3. In an electrical connector according to claim 1, in which said female contacts are imbedded in said first insulating body which carries them and said second insulating body has a frontal face from which project said male contacts which it carries, the improvement that said control means are a part of said first insulating body means arranged so that it can be displaced in the direction in which said female contacts extend and that said first insulating body means comprises, associated with each female contact, a cavity into which the above-mentioned boss extends, said cavity having a depth which varies longitudinally between a maximum depth at the back, for which the movable piece can be placed in a deflected position, and a minimum depth at the front, for which the bottom of the cavity acts on the above-mentioned projecting boss to bring the movable piece into its gripped position.

4. Connector according to claim 3, wherein the cavity is a longitudinal groove comprising, at the back, a part of constant depth and, at the front, a part whose depth decreases from back to front.

5. Electrical connector according to claim 4, wherein the front part of the said groove has a depth which decreases regularly from back to front and which forms a rectilinear ramp.

6. Electrical connector according to claim 3, wherein the cavity is an annular groove which comprises, at the back, a cylindrical part of constant depth and, at the front, a truncated conical part converging toward the front.

7. In an electrical connector according to claim 1, in which the female contacts are imbedded in the first insulating body means which carries them and the second insulating body means has a frontal face from which project the male contacts which it carries, the improvement that said control means comprise a transverse unit movable perpendicularly to the general axis of the female contacts, said movable transverse unit being provided with at least as many abutments as the first connector portion comprises female contacts, each abutment being placed so as to cooperate with the boss of the resilient strip of the corresponding female contact when the movable transverse unit is displaced.

8. Electrical connector according to claim 7, wherein the movable transverse unit is a flat plate.

9. Electrical connector according to claim 8, wherein the flat plate presents grooves whose bottoms form the abutments.

10. Electrical connector according to claim 8, wherein the flat plate presents holes, each hole surrounding the central part of the corresponding female contact, the edge of each hole located in front of the central part of the corresponding female contact forming the abutment.

11. Electrical connector according to claim 8, wherein the first insulating body is constituted of two components not juxtaposed to each other, the flat plate being movable between said components of the first insulating body.

12. Electrical connector according to claim 7, wherein the displacement of the movable transverse unit in the direction bringing it into contact with the bosses of the female contacts is controlled by the axial displacement of an exterior piece of the connector.

13. Electrical connector according to claim 12, wherein said exterior piece is a locking ring, the internal surface of which is provided with a ramp suitable for cooperating with a corresponding surface provided on the movable transverse unit.

14. Electrical connector according to claim 12, wherein the movable transverse unit is brought back into its initial non-active position by resilient means.

15. Electrical connector according to claim 13, wherein the female contacts themselves are abutments for the transverse unit as said transverse unit comes back to its initial nonactive position.

16. In an electrical connector according to claim 1, in which the first insulating body means comprises a frontal face from which project, at least partially, the female contacts, and in which the second insulating body means comprises recesses and a frontal face on which said recesses open, each recess sheltering, at least partially, a male contact, the improvement that, for each female contact, the boss of the movable piece is situated on the exterior of the said first insulating body means and adjacent to its frontal face, and that the control means are constituted by a bearing area arranged on the front part of the internal surface of the axial recess of the second insulating body means, the relative positions of the boss and of the bearing area being such that their cooperation is made at the end plugging-in and that the more the two connector units are drawn toward each other, the stronger the grip of the male contact is by the female contact.

17. Electrical connector according to claim 16, wherein the orifice of the recess is provided with a truncated-conical shaped guiding part.

18. Electrical connector according to claim 1, wherein each female contact comprises a support surrounded by the external casing and presenting an axial slot located substantially in its median part.

19. Electrical connector according to claim 10, wherein fixing means are provided for making the resilient strip solid with the support.

20. Electrical connector according to claim 19, wherein the fixing means comprise, on the one hand, on the support, a hoop located toward the central part of the support and, on the other hand, on the resilient strip, tabs projecting laterally and folded back so as to assume the shape of the contour of the exterior surface of the hoop.

21. Electrical connector according to claim 20, wherein rotation clamping means are provided to prevent the resilient strip from turning around the hoop.

22. Electrical connector according to claim 21, wherein the rotation clamping means are a flat part of the resilient strip and a flat part on the hoop on its exterior surface diametrically opposite the support.

23. Electrical connector according to claim 20, wherein longitudinal clamping means are provided to prevent the resilient strip from being longitudinally displaced in relation to the hoop.

24. Electrical connecter according to claim 23, wherein the longitudinal clamping means are grooves provided in the exterior surface of the hoop, in which grooves the folded back tabs of the resilient strip engage.

25. In an electrical connector according to claim 1, in which the female connector unit comprises, in its back part, a second insulating body means carrying pins to which the electrical conductors are connected, the front part of the pins being arranged to cooperate with the back part of the sockets, the improvement that the back part of the resilient strips is permanently applied on the back pins.

26. In an electrical connector comprising a first connector unit, a first insulating body in said first connector unit, at least one non-projecting male contact as a plug carried by said first insulating body, the plug of which is protected in an axial recess in the said first insulating body, a second connector-unit, a second insulating body in said second unit, at least one projecting female contact as a socket suitable for coming into electrical contact with the above-mentioned plug in the connected position of the two connector units, said projecting socket having its active part projecting, at least partially, from the frontal face of the said second insulating body, the wall of said projecting socket being provided with at least one axial strip allowing the free end of said socket to be submitted to a reduction of its diameter so as to establish electrical contact with the non-projecting plug while permitting its introduction or its withdrawal with a weak or zero pressing-force with the said non-projecting plug, the improvement that, for the control of said reduction of diameter the bottom of recess of said non-projecting plug comprises at least one narrowing (in the direction of said bottom) adapted and located in said bottom so as to act on the said free end of said socket at the end of the connection, so that the more the two connector units are drawn towards each other, the stronger the pressing-force of the socket is on the non-projecting plug.

27. Electrical connector according to claim 26, in which the recess sheltering the plug is a cylinder-of-revolution, wherein the narrowing is a truncated-conical surface.

28. Electrical connector according to claim 27, wherein the truncated-conical surface extends axially along the whole length of the recess.

29. Electrical connector according to claim 26, wherein the socket comprises axial strips defining longitudinal slits therebetween, each strip consisting in itself a transversely movable part and adapted to come in contact with the plug, in the connected position, by the guiding of the narrowing of the plug recess.

30. Electrical connector according to claim 26, wherein the non-projecting contact is a pin and the projecting contact is a socket comprising axial strips separated from each other by longitudinal slits, each strip constituting in itself a transversely movable part, the bearing area of these strips being constituted by the free ends of said strips.

31. Electrical connector according to claim 26, wherein each plug is sheltered in a respective recess.

* * * * *